US008640866B1

(12) United States Patent
Dow

(10) Patent No.: US 8,640,866 B1
(45) Date of Patent: Feb. 4, 2014

(54) GOLF CLUB HOLDING ASSEMBLY

(76) Inventor: William S. Dow, Ruskin, FL (US)

( * ) Notice: Subject to any disclaimer, the term of this patent is extended or adjusted under 35 U.S.C. 154(b) by 276 days.

(21) Appl. No.: 13/015,354

(22) Filed: Jan. 27, 2011

(51) Int. Cl.
*A63B 55/00* (2006.01)

(52) U.S. Cl.
USPC ..... 206/315.2; 206/315.1; 206/315.9; 206/315.7; 206/315.6; 206/315.5; 206/315.3; D3/320; D3/328.1; D3/259; D3/255

(58) Field of Classification Search
USPC ..... 206/315.1, 315.2, 315.9, 315.7, 315.6, 206/315.5, 315.3; D3/320, 328.1, 259, 255
See application file for complete search history.

(56) References Cited

U.S. PATENT DOCUMENTS 4,869,365 A * 9/1989 Perdue et al. ..... 206/315.5
5,301,519 A * 4/1994 Howorka ..... 62/457.5
D352,392 S * 11/1994 Little ..... D3/255
5,417,334 A 5/1995 Wu
5,474,191 A 12/1995 Bergeron et al.
5,560,479 A * 10/1996 Leyba et al. ..... 206/315.5
5,873,471 A 2/1999 Ruggeri
D480,870 S 10/2003 Wampler et al.
7,059,470 B2 * 6/2006 Slankster ..... 206/315.3
7,235,022 B2 6/2007 Pepe
7,549,534 B1 6/2009 Parpart
2010/0193559 A1 * 8/2010 Van Huyssteen et al. .... 224/680

* cited by examiner

*Primary Examiner* — Anthony Stashick
*Assistant Examiner* — Cynthia Collado

(57) ABSTRACT

A golf club holding assembly includes a panel that has a perimeter edge including top edge, a bottom edge, a first lateral edge, a second lateral edge, a front side and a back side. A plurality of club pockets is attached to the front side. Each of the club pockets is vertically orientated and is laterally aligned with each other. The club pockets each have an upper end form an access opening configured to receive a golf club handle. The plurality of club pockets includes at most four club pockets and at least two club pockets. A coupler is attached to the panel and is configured to releasably secure the panel to a golf bag.

16 Claims, 5 Drawing Sheets

GOLF CLUB HOLDING ASSEMBLY

BACKGROUND OF THE DISCLOSURE

Field of the Disclosure

The disclosure relates to golf club holding devices and more particularly pertains to a new golf club holding device for holding a select few clubs which are used often around or on a golfing green.

SUMMARY OF THE DISCLOSURE

An embodiment of the disclosure meets the needs presented above by generally comprising a panel that has a perimeter edge including top edge, a bottom edge, a first lateral edge, a second lateral edge, a front side and a back side. The panel has a height from the bottom edge to the top edge between 24 inches and 48 inches and a width from the first lateral edge to the second lateral edge between 4 inches and 10 inches. A plurality of club pockets is attached to the front side. Each of the club pockets is vertically orientated and is laterally aligned with each other. Each of the club pockets has a depth of at least 18 inches. The club pockets each have an upper end form an access opening configured to receive a golf club handle. The plurality of club pockets includes at most four club pockets and at least two club pockets. A coupler is attached to the panel and is configured to releasably secure the panel to a golf bag.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
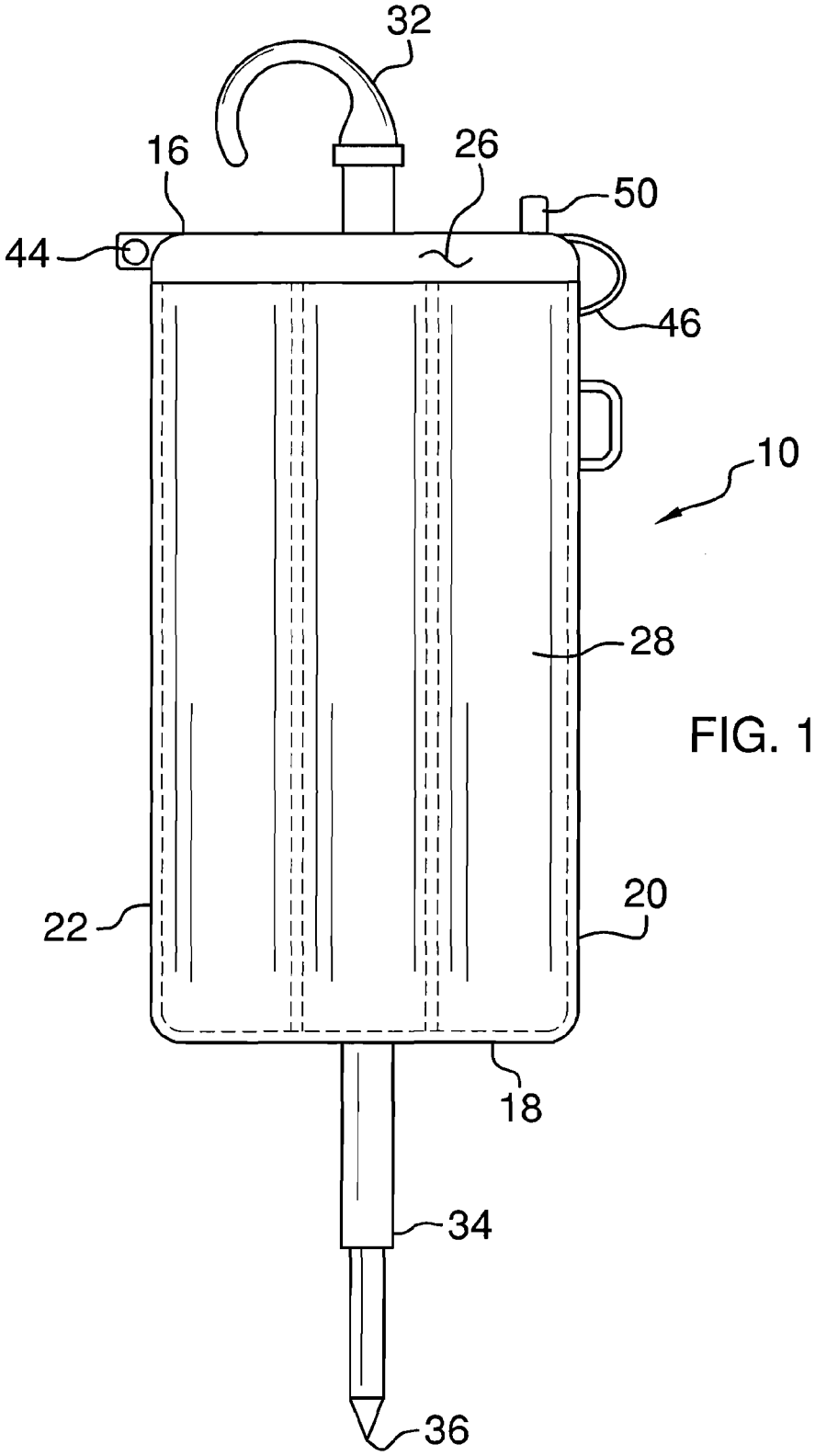
FIG. 1 is a front view of a golf club holding assembly according to an embodiment of the disclosure.
Figure 2:
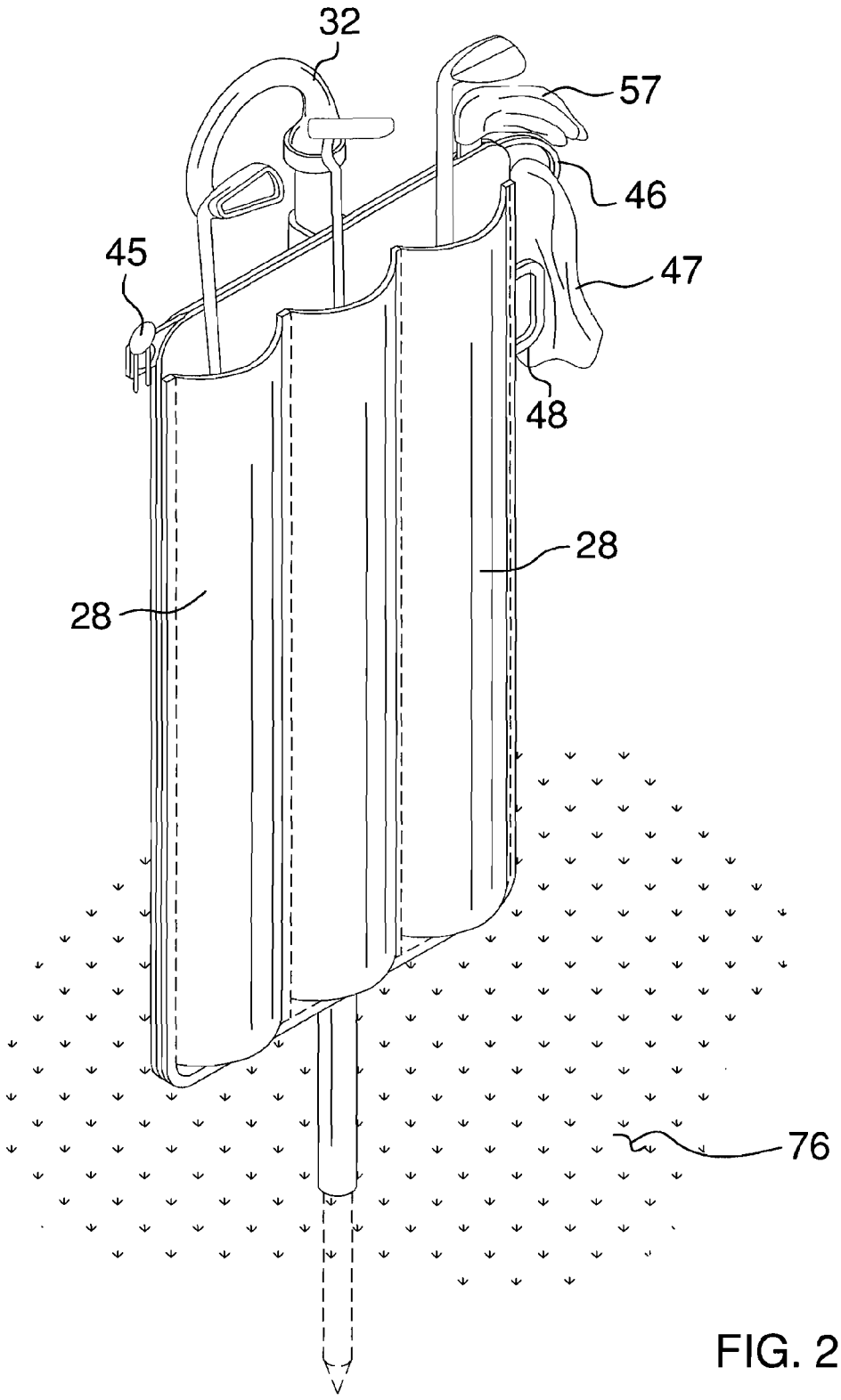
FIG. 2 is a perspective top view of an embodiment of the disclosure.
Figure 3:
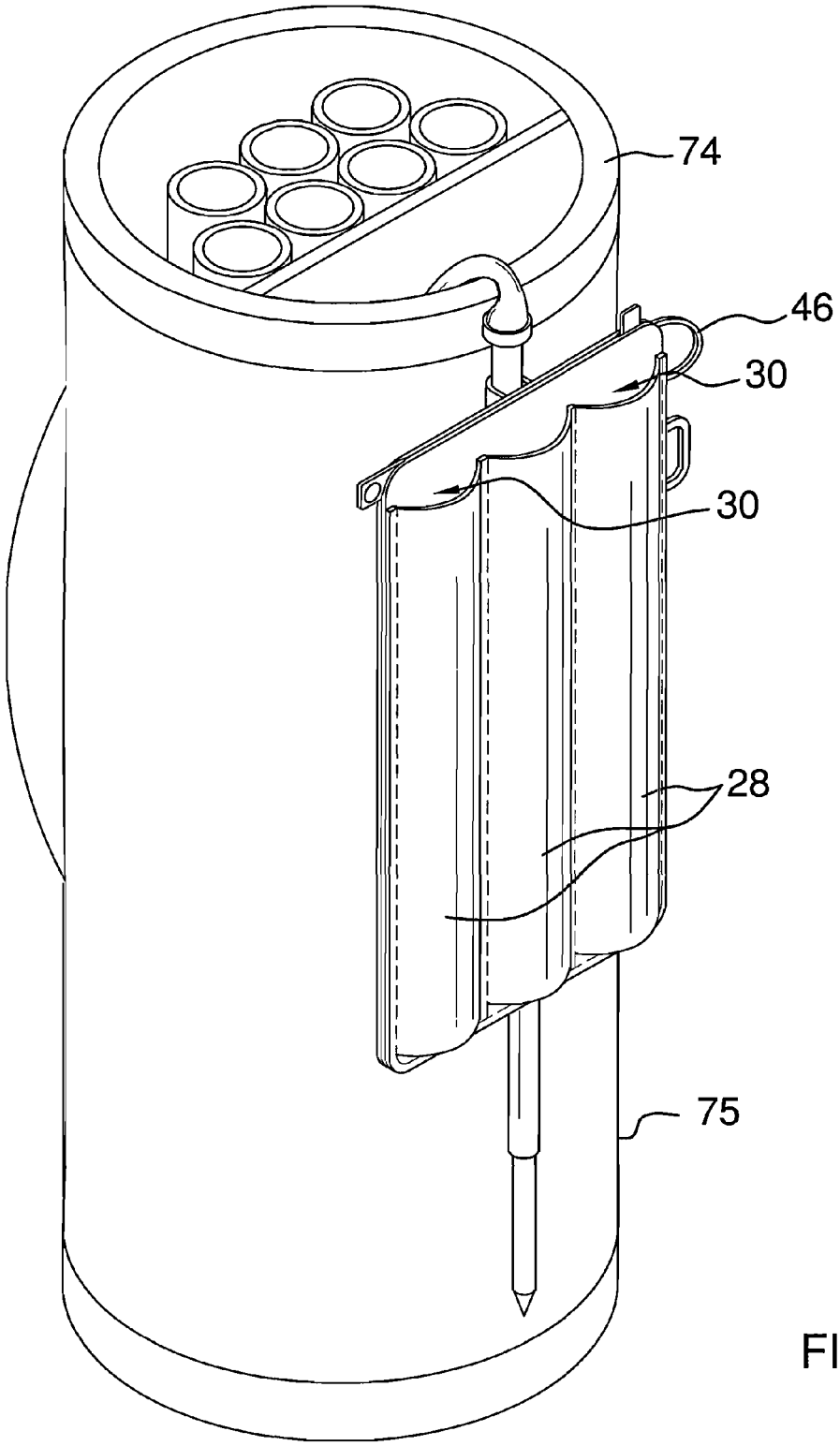
FIG. 3 is a perspective in-use view of an embodiment of the disclosure.

With reference now to the drawings, and in particular to FIGS. 1 through 5 thereof, a new golf club holding device embodying the principles and concepts of an embodiment of the disclosure and generally designated by the reference numeral 10 will be described.

As best illustrated in FIGS. 1 through 5, the golf club holding assembly 10 generally comprises a panel 12 that has a perimeter edge 14 including top edge 16, a bottom edge 18, a first lateral edge 20 and a second lateral edge 22. The panel 12 has a height from the bottom edge 18 to the top edge 16 between 24 inches and 48 inches and a width from the first lateral edge 20 to the second lateral edge 22 between 4 inches and 10 inches. The panel has a back side 24 and front side 26.

A plurality of club pockets 28 is attached to the front side. Each of the club pockets 28 is vertically orientated and is laterally aligned with each other. Each of the club pockets 28 has a depth of at least 18 inches. The club pockets 28 each have an upper end forming an access opening 30 configured to receive a golf club handle. The plurality of club pockets 28 includes at most four club pockets 28 and at least two club pockets 28. The upper ends of the club pockets, or access openings 30, are free of a closure so that the club pockets 28 cannot be closed. The access openings 30, and club pockets 28 in general, are configured to only hold one golf club at a time.

A coupler 32 is attached to the panel 12 and is configured to releasably secure the panel 12 to an upper edge 74 of a conventional golf bag 75. The coupler 32 comprises a hook extending upwardly from the top edge 74. It should be understood that since the coupler 32 has an upside down U-shape as shown in FIG. 1, it may be used as a grip for carrying the panel. The coupler 32 may be rotational with respect to the panel 12.

Figure 5:
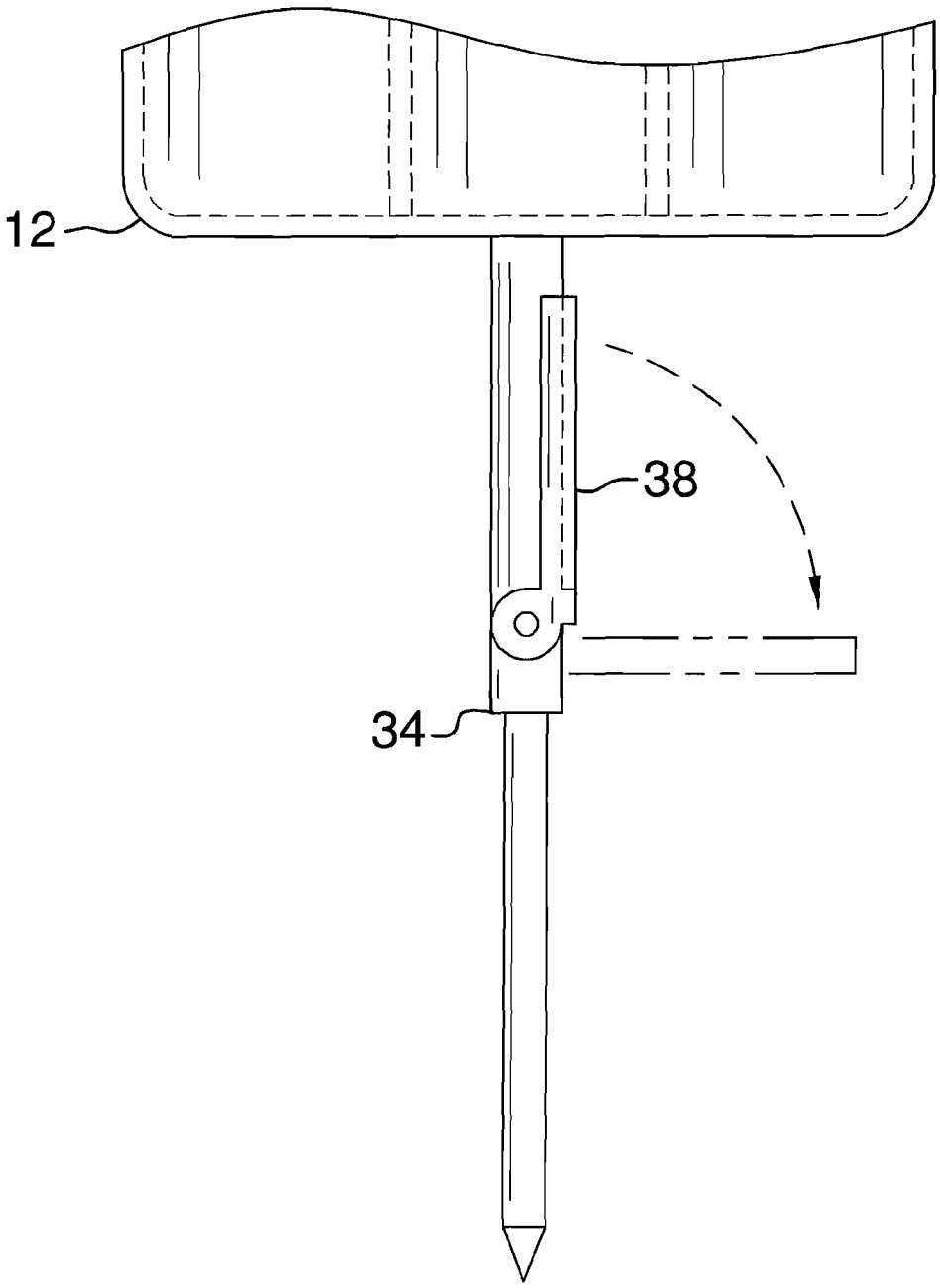
FIG. 5 is a front view of an embodiment of a stake of the disclosure.

A stake 34 is attached to the panel 12 and extends downwardly from the bottom edge 18. The stake 34 has a pointed bottom end 36 to facilitate insertion of the bottom end 36 into a ground surface 76. As shown in FIG. 5, a foot plate 38 may be attached to the stake 34. The foot plate 38 is configured to be stepped upon by a foot to urge the stake 34 into the ground surface 76. The foot plate 38 is pivotally coupled to the stake 34 and is positionable in a deployed position orientated perpendicular to the stake 34 or in a stored position folded against the stake 34.

Figure 4:
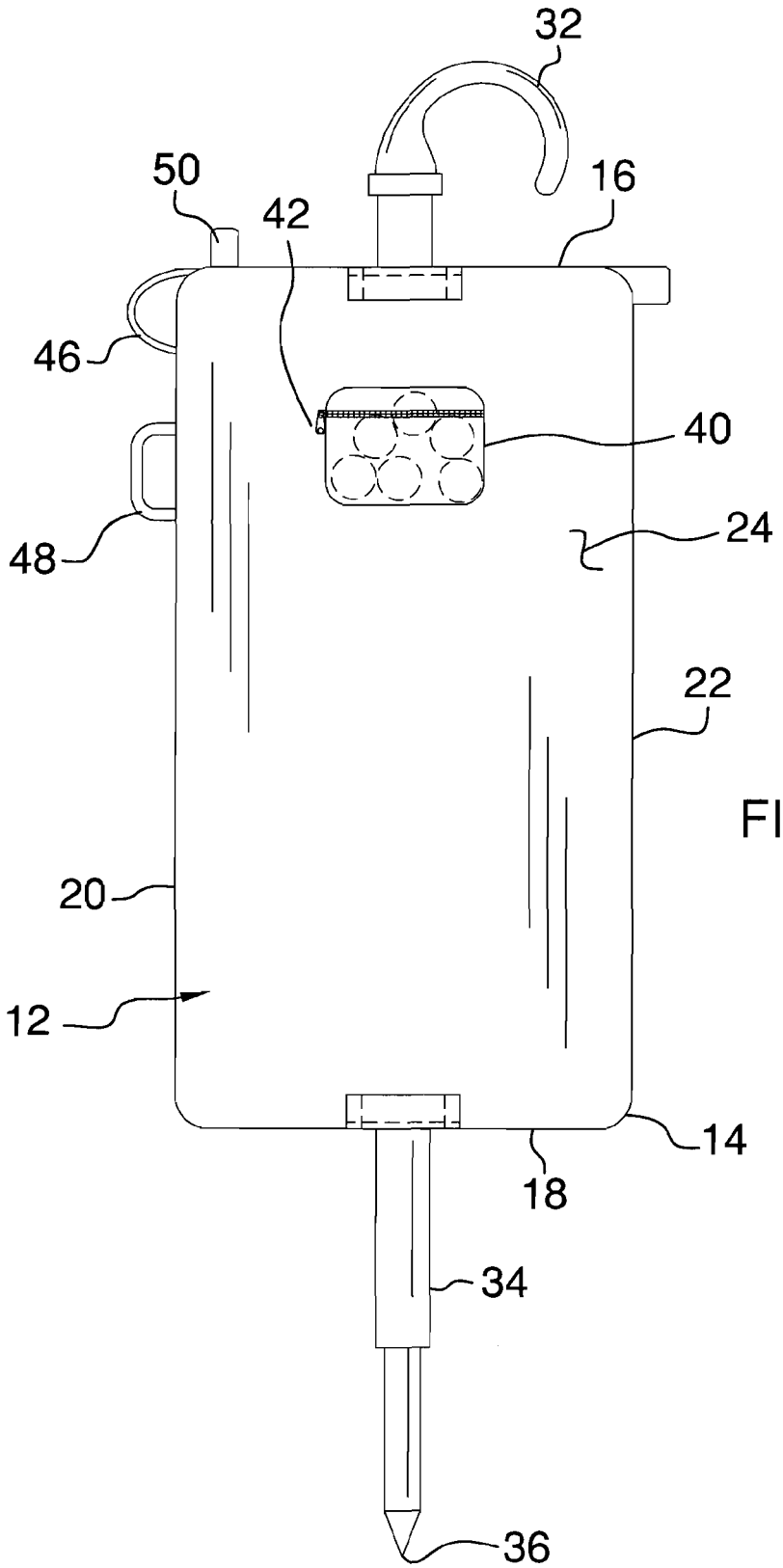
FIG. 4 is a back view of an embodiment of the disclosure.

An accessory pocket 40 is attached to the back side 24. The accessory pocket 40 includes a closure 42, such as a zipper as shown in FIG. 4, to selectively close the accessory pocket 40. The accessory 40 pocket comprises an only pocket on the back side. The accessory pocket 40 may be used for holding golf balls, tees, ball markers and the like, though the accessory pocket 40 would likely have an inner area of less than 50 $in^3$. A magnet 44 is attached to the panel 12. The magnet 44 is configured to be magnetically coupled to a ball marker 45. A loop 46 is attached to the panel 12 and is configured to receive a towel 47. A handle 48 is attached to the panel 12. The handle 48 is positioned on the first lateral edge 20 and may be used for carrying and manipulating the panel 12. A post 50 is attached to and extends upwardly from the panel 12. The post 50 is configured to be extendable into a golf glove 51.

In use, a golfer will place in the club pockets 28 those golf clubs that are used most often and typically around a green. Therefore, the golfer would likely use one club pocket 28 for a putter and the remaining club pockets 28 for wedges. The panel 12 allows a person to quickly access these clubs when approaching a green by simply decoupling the coupler from the golf bag 75. This will serve two purposes. First, it will allow for quicker play as the golfer will already have those clubs most commonly used at their disposal. Second, it will reduce the loss of clubs, and especially wedges, which occurs often around a green as golfers have to place their wedges down while putting. The stake 34 may be used to retain the contained clubs in an upright position.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A golf club holding apparatus configured to be removably mounted on an upper edge of a golf bag, said apparatus comprising:

a panel having a perimeter edge including top edge, a bottom edge, a first lateral edge, a second lateral edge, a front side and a back side, said panel having a height from said bottom edge to said top edge between 24 inches and 48 inches and a width from said first lateral edge to said second lateral edge between 4 inches and 10 inches;

a plurality of club pockets being attached to said front side, each of said club pockets being vertically orientated and being laterally aligned with each other, each of said club pockets having a depth of at least 18 inches, said club pockets each having an upper end forming an access opening configured to receive a golf club handle, said plurality of club pockets including at most four club pockets and at least two club pockets; and a coupler being attached to said panel and being configured to releasably secure said panel to the golf bag, said coupler being rotational with respect to said panel; and a loop being attached to said panel, said loop being configured to receive a towel.

2. The apparatus according to claim 1, wherein said upper ends of said club pockets are free of a closure.

3. The apparatus according to claim 1, wherein said coupler comprises a hook extending upwardly from said top edge.

4. The apparatus according to claim 1, further including a stake being attached to said panel and extending downwardly from said bottom edge, said stake having a pointed bottom end to facilitate insertion of said bottom end into a ground surface, said stake defining an only leg extending downwardly from said panel.

5. The apparatus according to claim 4, further including a foot plate being attached to said stake, said foot plate being configured to be stepped upon by a foot to urge said stake into the ground surface.

6. The apparatus according to claim 5, wherein said foot plate is pivotally coupled to said stake and being positionable in a deployed position orientated perpendicular to said stake or in a stored position folded against said stake.

7. The apparatus according to claim 2, further including an accessory pocket being attached to said back side.

8. The apparatus according to claim 7, said accessory pocket including a closure to selectively close said accessory pocket.

9. The apparatus according to claim 8, wherein said accessory pocket comprises an only pocket on said back side.

10. The apparatus according to claim 1, further including a magnet being attached to said panel, said magnet being configured to be magnetically coupled to a ball marker.

11. The apparatus according to claim 1, further including a handle being attached to and extending outwardly from said panel, said handle being positioned on said first lateral edge.

12. The apparatus according to claim 1, further including a post being attached to and extending upwardly from said panel, said post being configured to be extendable into a golf glove.

13. The apparatus according to claim 10, further including a stake being attached to said panel and extending downwardly from said bottom edge, said stake having a pointed bottom end to facilitate insertion of said bottom end into a ground surface, said stake defining an only leg extending downwardly from said panel.

14. The apparatus according to claim 12, further including a stake being attached to said panel and extending downwardly from said bottom edge, said stake having a pointed bottom end to facilitate insertion of said bottom end into a ground surface, said stake defining an only leg extending downwardly from said panel.

15. A golf club holding apparatus configured to be removably mounted on an upper edge of a golf bag, said apparatus comprising:

a panel having a perimeter edge including top edge, a bottom edge, a first lateral edge, a second lateral edge, a front side and a back side, said panel having a height from said bottom edge to said top edge between 24 inches and 48 inches and a width from said first lateral edge to said second lateral edge between 4 inches and 10 inches;

a plurality of club pockets being attached to said front side, each of said club pockets being vertically orientated and being laterally aligned with each other, each of said club pockets having a depth of at least 18 inches, said club pockets each having an upper end forming an access opening configured to receive a golf club handle, said plurality of club pockets including at most four club pockets and at least two club pockets, said upper ends of said club pockets being free of a closure;

a coupler being attached to said panel and being configured to releasably secure said panel to the golf bag, said coupler comprising a hook extending upwardly from said top edge;

a stake being attached to said panel and extending downwardly from said bottom edge, said stake having a pointed bottom end to facilitate insertion of said bottom end into a ground surface;

a foot plate being attached to said stake, said foot plate being configured to be stepped upon by a foot to urge said stake into the ground surface, said foot plate being pivotally coupled to said stake and being positionable in a deployed position orientated perpendicular to said stake or in a stored position folded against said stake;

an accessory pocket being attached to said back side, said accessory pocket including a closure to selectively close said accessory pocket, said accessory pocket comprising an only pocket on said back side;

a magnet being attached to said panel, said magnet being configured to be magnetically coupled to a ball marker;

a loop being attached to said panel, said loop being configured to receive a towel;

a handle being attached to said panel, said handle being positioned on said first lateral edge; and a post being attached to and extending upwardly from said panel, said post being configured to be extendable into a golf glove.

16. A golf club holding apparatus configured to be removably mounted on an upper edge of a golf bag, said apparatus comprising:

a panel having a perimeter edge including top edge, a bottom edge, a first lateral edge, a second lateral edge, a front side and a back side, said panel having a height from said bottom edge to said top edge between 24 inches and 48 inches and a width from said first lateral edge to said second lateral edge between 4 inches and 10 inches;

a plurality of club pockets being attached to said front side, each of said club pockets being vertically orientated and being laterally aligned with each other, each of said club pockets having a depth of at least 18 inches, said club pockets each having an upper end forming an access opening configured to receive a golf club handle, said plurality of club pockets including at most four club pockets and at least two club pockets, said upper ends of said club pockets being free of a closure;

a coupler being attached to said panel and being configured to releasably secure said panel to the golf bag, said coupler comprising a hook extending upwardly from said top edge, said coupler being rotational with respect to said panel;

a stake being attached to said panel and extending downwardly from said bottom edge, said stake having a pointed bottom end to facilitate insertion of said bottom end into a ground surface;

an accessory pocket being attached to said back side, said accessory pocket including a closure to selectively close said accessory pocket, said accessory pocket comprising an only pocket on said back side;

a magnet being attached to said panel, said magnet being configured to be magnetically coupled to a ball marker;

a loop being attached to said panel, said loop being configured to receive a towel;

a handle being attached to and extending outwardly from said panel, said handle being positioned on said first lateral edge; and a post being attached to and extending upwardly from said panel, said post being configured to be extendable into a golf glove.

* * * * *